United States Patent [19]

Troen

[11] Patent Number: 4,723,200

[45] Date of Patent: Feb. 2, 1988

[54] ELECTRIC LIGHT HOLDER

[75] Inventor: Lars Troen, Etobicoke, Canada

[73] Assignee: Larslight Corporation, Toronto, Canada

[21] Appl. No.: 924,943

[22] Filed: Oct. 30, 1986

[51] Int. Cl.[4] ..... F21K 29/00; H01J 7/44

[52] U.S. Cl. ..... 362/260; 362/296; 315/58; 315/57; 315/71; 339/54; 339/55; 339/76

[58] Field of Search ..... 362/296, 260, 263, 376, 362/377, 378; 339/144 R, 144 T, 146, 54, 55, 76, 145 T; 313/318; 315/56, 57, 58, 70, 71

[56] References Cited

U.S. PATENT DOCUMENTS

| | | | |
|---|---|---|---|
| 613,647 | 11/1898 | Brown . | |
| 2,505,993 | 5/1950 | Rogers | 315/58 |
| 3,112,894 | 12/1963 | Pearlman | 362/296 |
| 3,163,768 | 12/1964 | Bernhein | 362/296 X |
| 3,372,302 | 3/1968 | Fasola | 315/71 X |
| 3,781,593 | 12/1973 | Rodriguez | 315/58 |
| 3,836,814 | 9/1974 | Rodriquez | 315/71 X |
| 4,039,821 | 8/1977 | Greene et al. . | |
| 4,495,443 | 1/1985 | Cummings | 315/56 X |
| 4,503,360 | 3/1985 | Bedel | 315/56 X |
| 4,570,105 | 2/1986 | Engel | 339/55 X |
| 4,623,823 | 11/1986 | Engel | 339/55 X |

*Primary Examiner*—Larry Jones

*Attorney, Agent, or Firm*—Rogers, Bereskin & Parr

[57] ABSTRACT

An electric light holder having a base and a socket to receive a bulb. The socket is removably held to the base by a pair of outwardly extending opposed plastic wings at the front of the base which snap into grooves at the sides of the socket. The wings also serve as stops for the rear of a reflector which is slid over the socket and held in place against the wings by a retainer ring threaded over the socket. Alternatively the reflector can be suspended from the wings.

12 Claims, 8 Drawing Figures

ELECTRIC LIGHT HOLDER

FIELD OF THE INVENTION

This invention relates to an electric light holder having improved means for retaining a socket and a reflector.

BACKGROUND OF THE INVENTION

Electric light holders are used to retain and energize a wide variety of electric light bulbs, including for example miniature fluorescent tubes. It is commonly necessary to mount a reflector on the holder, to reflect the light from the light bulb in a desired direction. In the past, the physical structure required to mount the reflector has been relatively cumbersome, expensive and awkward to use.

BRIEF SUMMARY OF INVENTION

Therefore it is an object of the present invention to provide an electrical light holder which includes improved means for retaining both a socket and a reflector in a simple manner. Accordingly in one of its aspects the invention provides an electrical light holder comprising:

(a) a base having a forward end, (b) a pair of wings projecting laterally outwardly in substantially opposed directions from said forward end, (c) a socket having a forward end for receiving an electric bulb and having a rear end, (d) said socket having an outer surface and a pair of grooves in said outer surface, said grooves being spaced apart from each other around said outer surface and each having a predetermined width, (e) detent means on each groove, (f) said wings each being of thickness less than the width of said grooves, said wings having inner ends defining therebetween a space for the rear end of said socket to be placed between said inner ends with said inner ends located one in each groove, (g) said inner ends of said wings each including retaining means cooperating with said detent means of said grooves to releasably secure said socket to said base, said wings being of a flexible material so that they can be flexed to release said retaining means of said wings from said detent means of said grooves, (h) said outer surface of said socket having ring retaining means thereon, (i) and a retainer ring adapted to be mounted on said ring retaining means to secure a reflector over said socket between said retainer ring and said wings.

BRIEF DESCRIPTION OF THE DRAWINGS

Further objects and advantages of the invention will appear from the following description, taken together with the accompanying drawings in which.

DETAILED DESCRIPTION OF PREFERRED EMBODIMENTS

Figure 1:
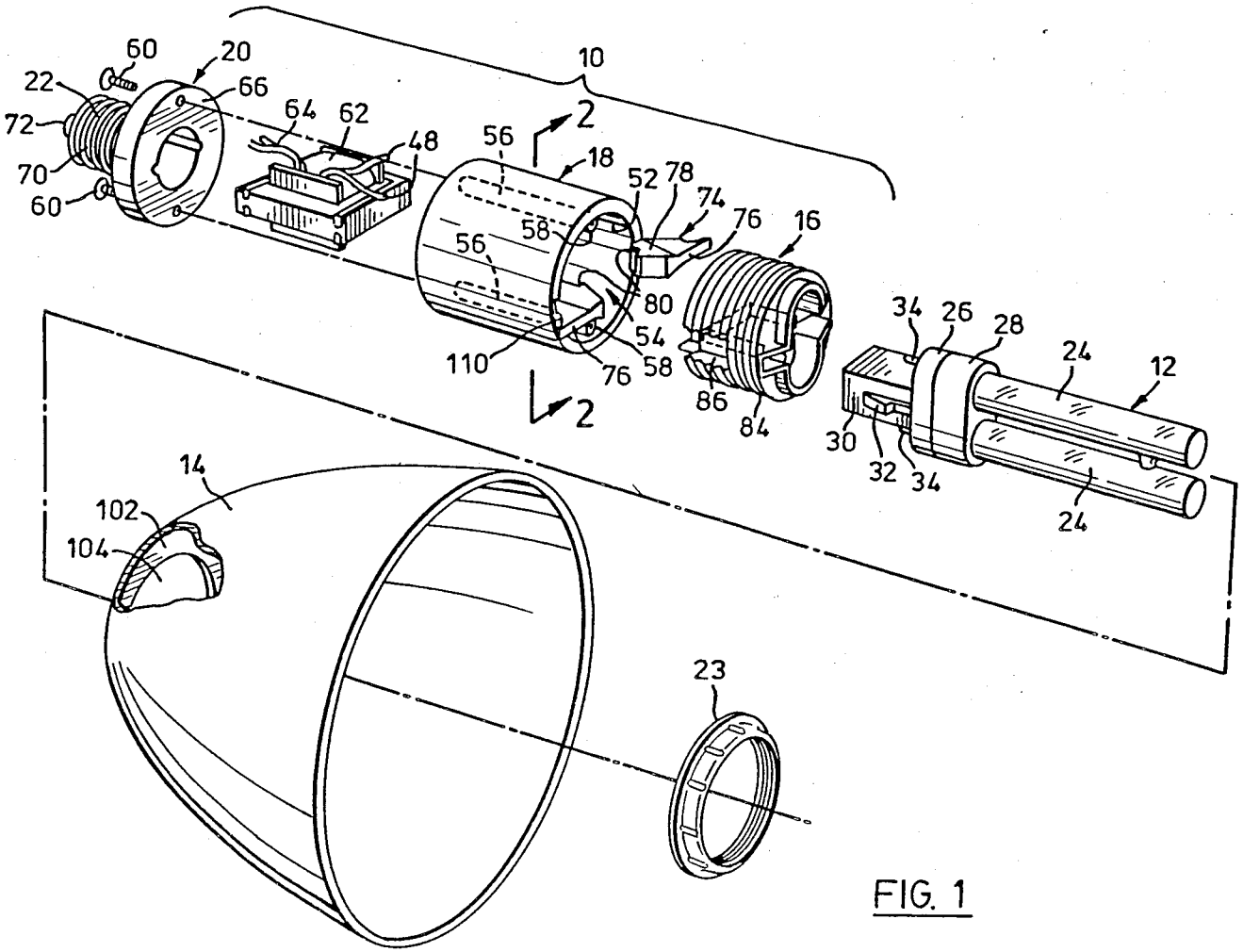
FIG. 1 is a perspective exploded view of an electric light holder, with a light bulb and reflector, according to the invention.

Reference is first made to FIG. 1, which shows an electric light holder 10, together with a miniature fluorescent bulb 12 and a reflector 14. The holder 10 includes a socket 16 to receive the bulb 12, a cylindrical base 18 which secures the socket 16 in a manner to be described, and an end piece 20 having a tip 22 which can be screwed into a conventional incandescent bulb socket (not shown). The holder also includes a reflector retaining ring 23.

The bulb 12 is conventional and includes glass fluorescent tubes 24 and a molded plastic base 26 having a metal cap 28 to secure the tubes 24. The plastic base 26 includes a plastic rectangular rear plug portion 30 having a pair of projecting wedges 32 (of which only one is shown) integral therewith, and a pair of metal pins 34 to connect the bulb electrically to the socket 16.

Figure 2:
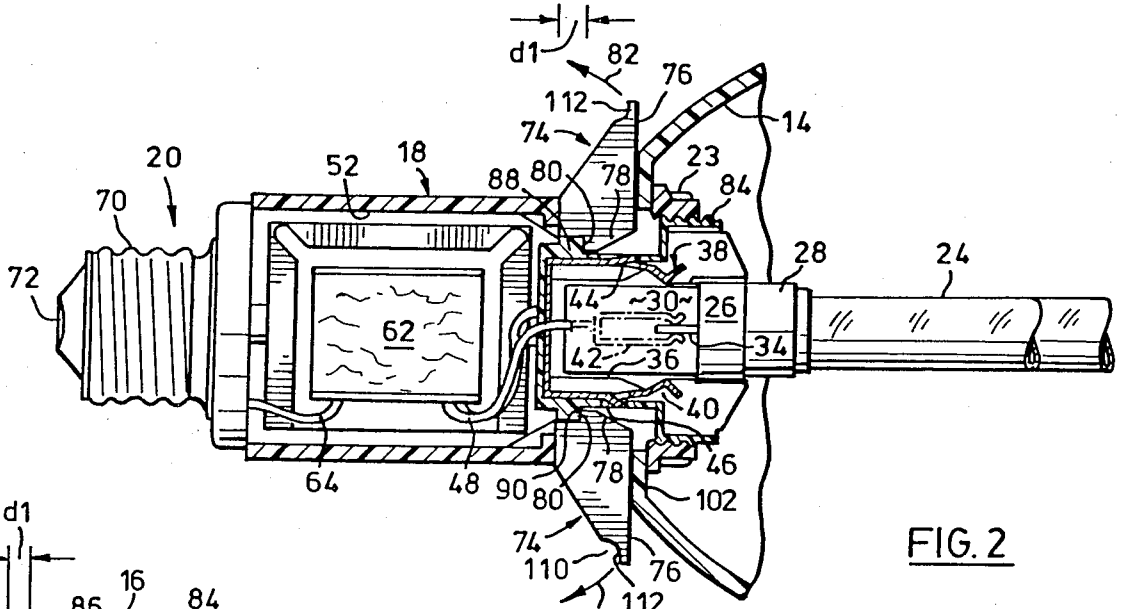
FIG. 2 is a view, partly in section taken along lines 2—2 of FIG. 1 but with the holder, reflector and bulb assembled.
Figure 5:
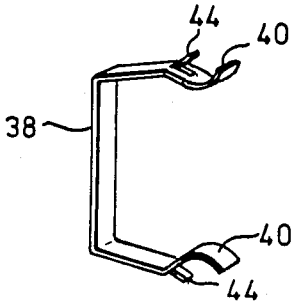
FIG. 5 is perspective view of a retainer spring from the socket of FIGS. 3 and 4.

The interior of the socket 16 is also conventional and therefore will be described only briefly. As shown in FIG. 2, the interior of the socket 16 includes a rectangular opening 36 to receive the plastic plug portion 30, a generally U-shaped metal retaining spring 38 (see also FIG. 5) having inwardly projecting V-shaped ends 40 to grip the wedges 32 and removably hold the bulb 12 in position, and a pair of U-shaped copper connectors 42 to grip the pins 34 and make electrical connections to the bulb. The retaining spring 38 is held in the opening 36 by metal tabs 44 which are struck out from the legs of the retaining spring 38 as best shown in FIG. 5. The tabs 44 extend through openings 46 in the wall of the socket 16, as will be described.

Figure 4:
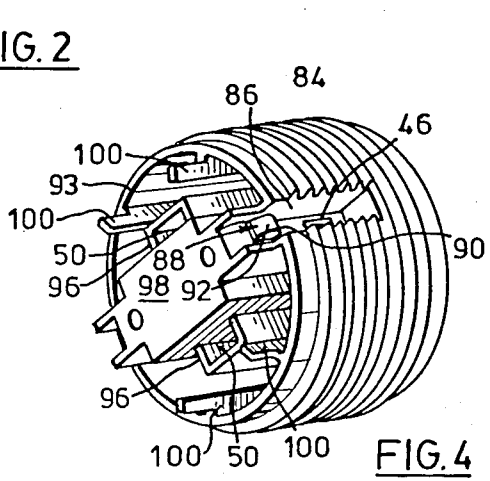
FIG. 4 is a perspective rear view of the socket shown in FIG. 3.

The socket 16 is of one-piece molded plastic construction, except of course for the retaining spring 38 and the copper connectors 42. The connectors 42 are, together with their connecting wires 48, press fitted into rectangular openings 50 (see FIG. 4) at the rear end of the socket 16.

The base 18 is a cylindrical molded plastic piece having an interior wall 52 defining an interior opening 54. Located on the interior wall 52 are two opposed axially extending tubular channels 56. The tubular channels 56 have interior openings 58 to receive screws 60 as shown in FIG. 1.

The interior opening 54 of base 18 serves to house a conventional ballast 62 (or if desired an electronic ballast), from which the wires 48 extend to the socket 16. Further wires 64 extend from the ballast 62 into the end piece 20.

The end piece 20 includes a disk-shaped member 66 having openings 68 therein to accommodate the screws 60 which secure the end piece 20 to the base 18. The tip 22 of the end piece 20 is in the form of a conventional incandescent bulb base having a cylindrical metal thread 70 and a metal tip 72 so that it can be screwed into a conventional incandescent bulb socket.

The base 18 includes a novel pair of plastic wings 74 molded integrally with the base. The wings 74 are located on diametrically opposed sides of the forward end of the base 18 and each wing extends forwardly and radially outwardly. Each wing 74 is generally triangular in form and includes a flat front surface 76, the two front surfaces 76 together defining a plane (and a line) which extends through the axis of the base 18 and at right angles to such axis. The front surfaces 76 therefore serve to form a stop for the rear surface of the reflector 14, as will be described.

The radially inner surface of each wing 74 includes a generally triangular formation 78 which slopes radially inwardly and rearwardly, terminating in a rearward facing and radially extending wall 80. The wall 80 is spaced axially from the forward end wall 82 of the base 18 by a distance d1. The triangular formations 78 thereby constitute retaining means to grip and secure the socket 16, as will be described. The plastic material of the base 18 and wings 74 is sufficiently resilient to allow each wing 74 to rotate slightly in the direction indicated by arrow 82 when sufficient force is applied to the wings. The triangular formations 78 are made thicker (as best shown in FIG. 1) than the remainder of the wings, for increased strength.

The socket 16 includes an exterior threaded plastic wall 84 onto which the reflector retaining ring 23 can be screwed as will be described. However the exterior wall of the socket is interrupted by two relatively deep opposed grooves 86, one in each side thereof. Each groove 86 is dimensioned to receive (with some circumferential tolerance) the triangular formation 78 of a wing 74.

Figure 3:
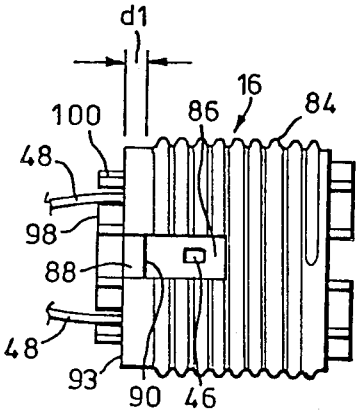
FIG. 3 is a side view of a socket of the FIG. 1 device.

In order that the wings 74 will snap into the grooves 86 and retain the socket 16 to the base, each groove 86 includes a transverse ridge 88 (FIGS. 3, 4) therein. Each ridge 88 includes a forward radially extending surface 90, and an outer surface 92 which slopes rearwardly and radially inwardly. The surface 90 of each ridge is spaced forwardly of the rear wall 93 of the socket by the same distance d1 previously mentioned.

In addition, the openings 46 which retain the tabs 44 of the retainer spring 38 are located in the bottom walls 94 of the grooves 56, forwardly of the ridges 88. The thickness of the walls 94 at the openings 46 is sufficient that the tabs 44 do not project radially outwardly therefrom. The openings 50 (see FIG. 4) for the connectors 42 are defined by U-shaped wall formations 96 extending outwardly from a central rectangular plastic formation 98 which defines the rectangular opening 36 in the socket. The formations 96 are spaced 90 degrees around the socket from each groove 86, so that the socket 16 may be of minimum exterior diameter without the grooves interfering with the connectors 42.

In assembly, the ballast 62 is glued into the base 18. The wires 48 from the ballast 62, together with the copper connectors 42, are pressed into the openings 50 in the bottom of the socket 16. The socket is then oriented so that the grooves 86 are aligned with the wings 74, and the socket is then pressed onto the base 18. Four circumferentially spaced plastic tabs or guide members 100 molded on the interior wall of the socket 16 and extending rearwardly from the rear wall 93 of the socket ensure that the socket 16 is fully aligned with the base 18.

As the socket 16 is pressed onto the base 18, the wings 74 enter the grooves 86 and are forced apart, until the triangular formations 78 of the wings snap over the ridges 88 of the socket (as shown in FIG. 2). This firmly holds the socket in position, with its rear wall 93 pressed tightly against the base 18. While the socket 16 can be removed by hand, without the need for any tools, this can only be done by pressing rearwardly on the flat forward surface 76 of either or both of the wings 74, to rotate them in the direction of arrow 82 (to move the triangular formations 78 outwardly clear of the ridges 88). Considerable force is needed for this operation, as required by most electrical codes, since the socket 16 should not become disassembled in normal use nor should small children be able to disassemble it.

The reflector 14 can be fitted simply by sliding it over the socket 16. The reflector 14 has a flat annular rear surface 102 having an opening 104 therein. The reflector rear surface 102 is located in a plane at right angles to the axis of the base 18. The flat rear surface 102 of the reflector therefore rests solidly against the flat forward surfaces 76 of the wings 74. The reflector 14 is then held in place by the reflector retaining ring 23 (also made of plastic), which has an interior thread 106 mating with the exterior thread of the socket 16.

Usually the bulb 12 is inserted or removed while the reflector 14 is in place, simply by inserting the user's hand into the opening of the reflector to grip the bulb. However if desired, the reflector 14 can be removed before bulb replacement, simply by unscrewing the retaining ring 23 and then removing the reflector.

Figure 6:
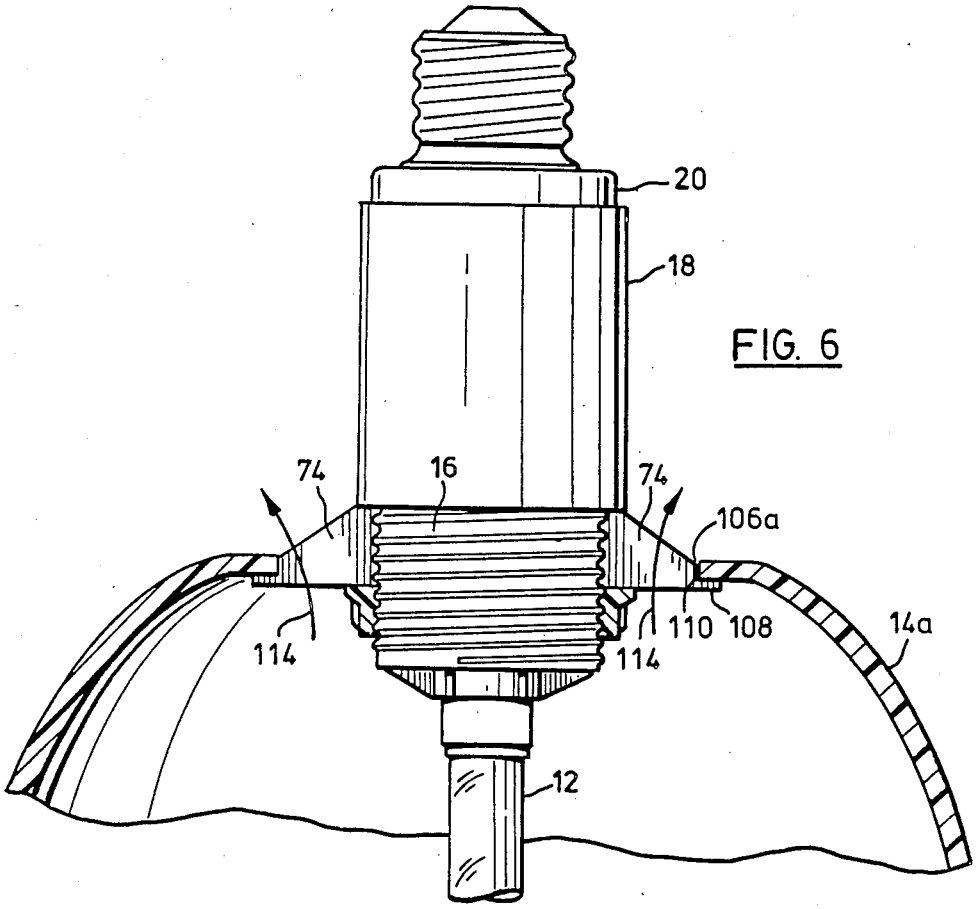
FIG. 6 is a side view, partly in section, showing the holder of FIG. 1 with a different reflector mounted thereon.

In some cases it may be desired to permit air to circulate between the base of the reflector and the socket 16, e.g. for cooling purposes. This can be arranged as shown in FIG. 6, which shows a modified reflector **14*a* having a flat rear surface 102 as before, but with a much larger opening 106*a* therein. It will be seen that the outer tips 108 of the wings 74 each have a cut-out 110 therein, defining a short rear radially outwardlyextending surface 112 at the tip of each wing. The reflector 14*a* may be hung on the surfaces 112, and air may then circulate (as shown by arrows 114) through the annular space between the reflector 14*a* and socket 16. This arrangement is of course used only when the light holder 10 is in a vertical position with the reflector 14*a*** hanging downwardly.

Figure 7:
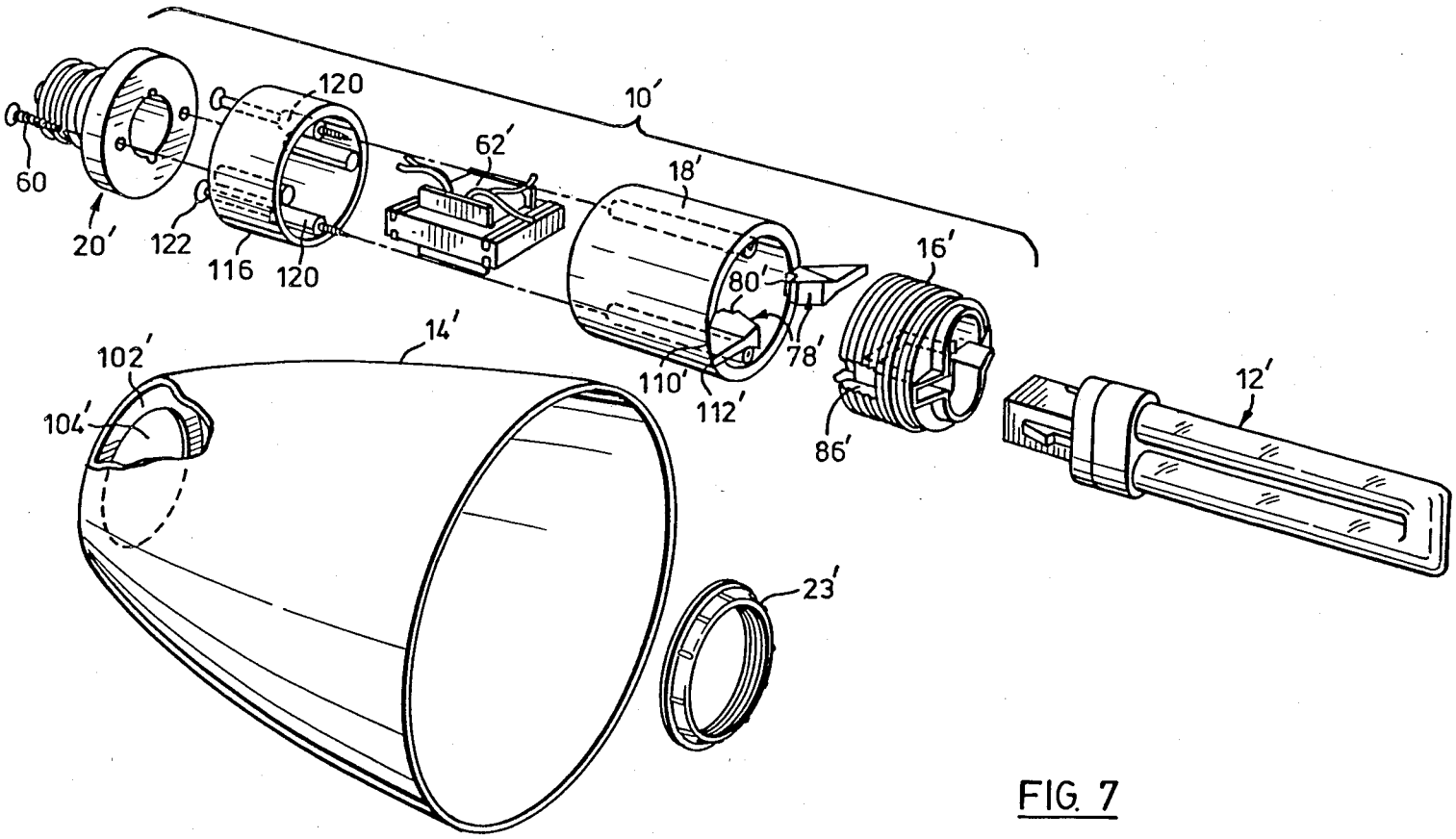
FIG. 7 is a perspective exploded view showing a modification of the holder of FIG. 1.
Figure 8:
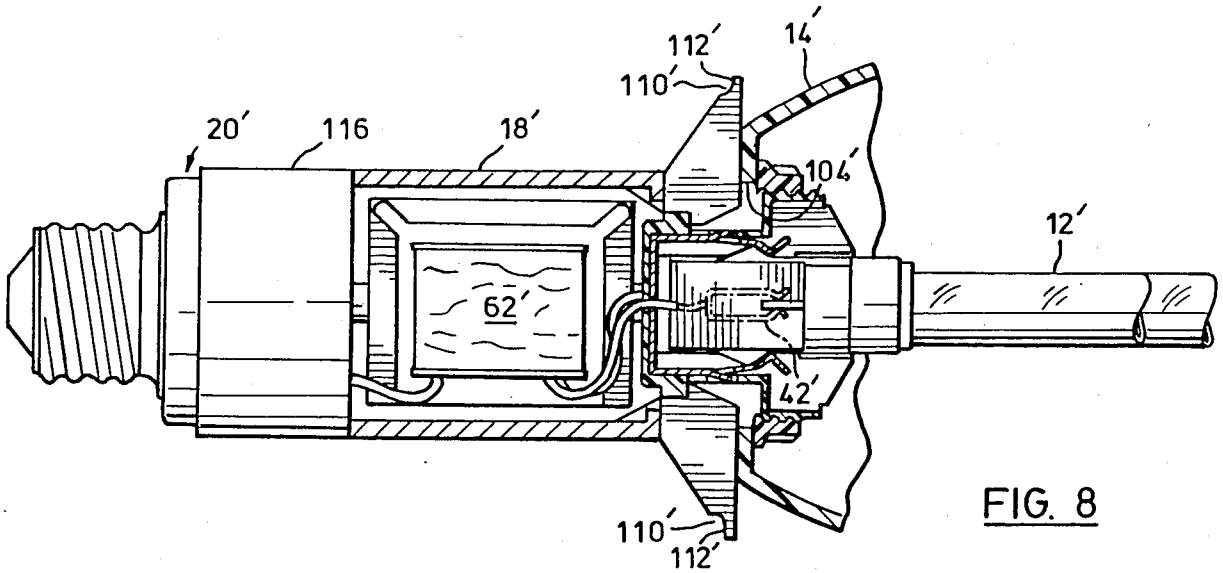
FIG. 8 is a side view, partly in section, showing the arrangement of FIG. 7 in assembled condition.

Reference is next made to FIGS. 7 and 8, which show an arrangement virtually identical with that of FIGS. 1 to 5 and in which primed reference numerals indicate corresponding parts. The major difference between the FIG. 7 and 8 arrangement and that described previously is that in the FIGS. 7 and 8 arrangement, the base 18' includes an extension 116 which serves to lengthen the base. The extension 116 is a molded cylindrical plastic piece, of the same diameter as base 18', and with two pairs of internal recessed screw channels 118, 120. Screw channels 118 are diametrically opposed and serve to receive screws 60' from the end piece 20'. Screw channels 120 are diametrically opposed, but are totated 90 degrees from channels 118 and serve to receive screws 122 to secure the extension 116 to base 18'.

In assembly, screws 122 are inserted into channels 120 to secure extension 116 to base 18'. Then the screws 60' are used to secure end piece 20' to extension 116.

In the FIG. 7 and 8 version the bulb 12' is conventional but is of slightly different form from that shown in FIG. 1. In addition the reflector 14' is shown as being narrower in width. It will be appreciated that the arrangement shown can accommodate a large range of reflectors of varying widths, so long as the rear end of the reflector used will fit over the socket 16 and have a flat end surface which rests against the forward surfaces of wings 74.

While two wings 74 have been shown, with two corresponding grooves 86, if desired three wings and three grooves can be used, spaced apart by 120 degrees instead of 180 degrees. However the use of two wings is preferred, both for compactness, reduced cost, and ease of assembly and disassembly.

It will be seen that the wings 74 perform the dual functions of both retaining the socket 16 to the base 18, and also helping to mount the reflector.

All of the plastic molded parts described are normally of fire resistant plastic.

I claim:

1. An electric light holder comprising:

(a) a base having a forward end, (b) a pair of wings projecting laterally outwardly in substantially opposed directions from said forward end, (c) a socket having a forward end for receiving an electric bulb and having a rear end, (d) said socket having an outer surface and a pair of grooves in said outer surface, said grooves being spaced apart from each other around said outer surface and each having a predetermined width, (e) detent means in each groove, (f) said wings each being of thickness less than the width of said grooves, said wings having inner ends defining therebetween a space for the rear end of said socket to be placed between said inner ends with said inner ends located one in each groove, (g) said inner ends of said wings each including retaining means cooperating with said detent means of said grooves to releasibly secure said socket to said base, said wings being of a flexible material so that they can be flexed to release said retaining means of said wings from said detent means of said grooves, (h) said outer surface of said socket having ring retaining means thereon, (i) and a retainer ring adapted to be mounted on said ring retaining means to secure a reflector over said socket between said retainer ring and said wings.

2. An electric light holder according to claim 1 wherein said wings and said grooves are each two in number, said wings being spaced 180 degrees apart around said base and said grooves being spaced 180 degrees apart around said socket.

3. An electric light holder according to claim 2 wherein said grooves extend substantially to said rear end of said socket.

4. An electric light holder according to claim 1 wherein said ring retaining means is a screw thread extending around the outer surface of said socket, said screw thread being discontinuous at said grooves.

5. An electric light holder according to claim 1 wherein said base has a central longitudinal axis, and said wings have forward surfaces which together define a plane extending at right angles to said axis.

6. An electric light holder according to claim 1 wherein each wing has a forward surface and an inner surface, said retaining means of each wing comprising a formation which slopes rearwardly and radially inwardly from said forward surface and terminates in a rearward facing and radially extending wall.

7. An electric light holder according to claim 6 wherein said detent means of each groove comprises a ridge extending laterally across each groove adjacent the rear end of said groove, said ridge having a radially oriented forward surface and an outer surface which slopes rearwardly and radially inwardly therefrom.

8. The electric light holder according to claim 1 wherein said wings are generally triangular in shape as viewed from the side, each having a forward surface, a radially inner surface and an outer surface which slopes forwardly and radially outwardly from said base to the outer edge of said forward surface, said outer surface defining at the outer edge of each wing a substantially flat radially outwardly directed surface on which a reflector may be hung.

9. An electric light holder according to claim 1 wherein said base has a central longitudinal axis, and said wings have forward surfaces which together define a plane extending at right angles to said axis, said holder further including a reflector, said reflector having a rear flat surface having an opening therein, said opening being dimensioned to fit over said socket so that said rear flat surface may be pressed against the forward surfaces of said wings and held in place thereon by said retainer ring.

10. An electric light holder according to claim 1 wherein said socket includes a substantially U-shaped retainer spring to retain an electric bulb therein, said retainer spring having a pair of legs and tabs extending outwardly from said legs, said grooves each having a bottom wall having an opening therein to accommodate and retain a said tab.

11. An electric light holder according to claim 1 wherein said socket includes a main receptacle to accommodate the bottom of said electric bulb, a pair of pin receptacles one at each side of said main receptacle, said grooves being two in number and being spaced 180 degrees apart around said outer surface of said socket, each pin receptacle being spaced 90 degrees around said socket from each groove.

12. An electric light holder according to claim 1 wherein said base is of molded plastic and is substantially cylindrical in form, having an interior wall, and wherein said socket is of molded plastic and includes a plurality of plastic guide members projecting rearwardly therefrom, said guide members having outer surfaces and being dimensioned to fit within said base with the outer surfaces of said guide members pressed against the inner wall of said base, to align said socket with said base.

* * * * *